US010787990B2

(12) United States Patent
Stier

(10) Patent No.: US 10,787,990 B2
(45) Date of Patent: Sep. 29, 2020

(54) COOLING OF A PISTON BY MEANS OF SODIUM-FILLED TUBES

(71) Applicant: KS Kolbenschmidt GmbH, Neckarsulm (DE)

(72) Inventor: Ralf Stier, Neuenstadt a.K. (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 67 days.

(21) Appl. No.: 15/756,684

(22) PCT Filed: Sep. 9, 2016

(86) PCT No.: PCT/EP2016/071342
§ 371 (c)(1),
(2) Date: Mar. 1, 2018

(87) PCT Pub. No.: WO2017/042356
PCT Pub. Date: Mar. 16, 2017

(65) Prior Publication Data

US 2018/0252182 A1 Sep. 6, 2018

(30) Foreign Application Priority Data

Sep. 11, 2015 (DE) ..... 10 2015 217 468

(51) Int. Cl.

| | |
|---|---|
| ***F02F 3/18*** | (2006.01) |
| ***F01P 3/06*** | (2006.01) |
| ***F02F 3/22*** | (2006.01) |
| ***F02F 3/00*** | (2006.01) |
| *F01P 3/10* | (2006.01) |
| *B22C 9/10* | (2006.01) |

(52) U.S. Cl.
CPC *F02F 3/18* (2013.01); *F01P 3/06* (2013.01); *B22C 9/105* (2013.01); *F01P 3/10* (2013.01); *F02F 3/003* (2013.01); *F02F 3/22* (2013.01)

(58) Field of Classification Search
CPC ..... F02F 3/18; F02F 3/003; F02F 3/22; B22C 9/105; F01P 3/06; F01P 3/10
See application file for complete search history.

(56) References Cited

U.S. PATENT DOCUMENTS 6,904,876 B1 * 6/2005 Hofbauer ..... F02B 71/04 123/46 R
2015/0075455 A1 * 3/2015 Bischofberger ..... F02F 3/0084 123/41.35

FOREIGN PATENT DOCUMENTS

| | | | | |
|---|---|---|---|---|
| DE | 726 685 C | * | 9/1939 | ..... F02F 3/18 |
| DE | 726 685 C | | 10/1942 | |
| DE | 100 15 709 A1 | | 12/2001 | |
| DE | 10 2011 111319 A1 | | 2/2013 | |
| FR | 2 333 962 A1 | | 7/1977 | |
| JP | H04 265451 A | | 9/1992 | |

* cited by examiner

*Primary Examiner* — Kevin A Lathers
(74) *Attorney, Agent, or Firm* — Young Basile Hanlon & MacFarlane, P.C.

(57) ABSTRACT

Disclosed is an internal combustion engine piston wherein at least one space is formed into which a coolant is installed. In one example, the coolant is first introduced into a coolant container and the coolant container is thereafter inserted into the at least one space in the piston. In one example, the coolant is an alkali metal consisting of sodium.

20 Claims, 3 Drawing Sheets

COOLING OF A PISTON BY MEANS OF SODIUM-FILLED TUBES

TECHNICAL FIELD

Figure 1:
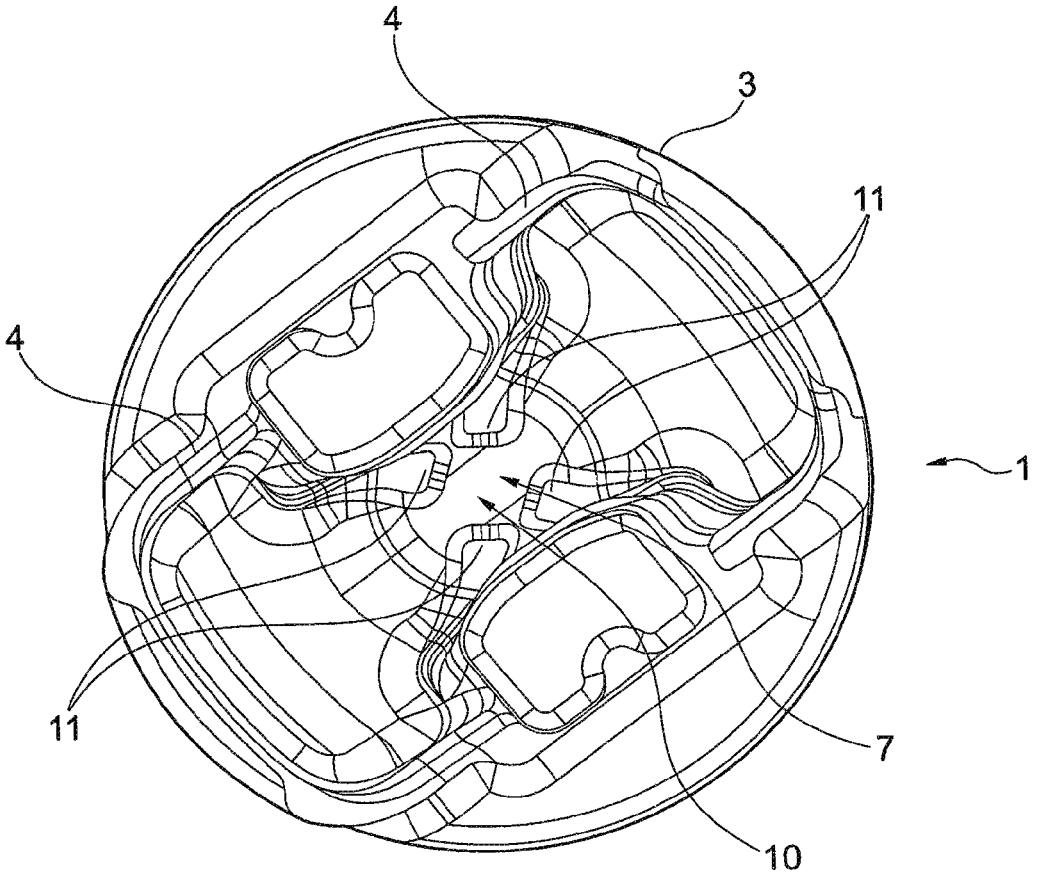

The invention relates to a combustion engine piston and to a method for the production of a piston.

BACKGROUND

DE 10 2013 002 895 A1 discloses a piston of a combustion engine, which has an upper part with a ring zone, wherein a piston skirt adjoins the upper part and at least one space, in this case elongate holes, is formed in the piston, into which at least one space a coolant, in this case an alkali metal, is introduced. In this known piston, the spaces are filled directly with the coolant and are closed after filling. Here, closure is effected by means of a ball, which is pressed into the introduction opening. An alkali metal, in particular sodium, is used as a coolant.

This way of enabling piston regions which are subject to high stresses in terms of temperature to be cooled by means of the alkali metal has proven itself in principle. However, it has been found that a production method for introducing the coolant into the space provided for this purpose is problematic. In this respect, it is necessary to work very carefully to ensure that the coolant is introduced only into the space provided for it and that nothing can escape into the environment. It is therefore an expensive and problematic process to introduce the coolant directly into the space provided for it. This problem is exacerbated by the fact that not only a single space but, in DE 10 2013 002 895 A1, a plurality of skewed holes, into which the coolant has to be introduced, is provided.

SUMMARY

It is therefore the underlying object of the invention to avoid the disadvantages described at the outset and to provide a piston and a method for the production of a piston of this kind by means of which the filling of the space with a cooling medium is simpler.

In respect of the piston, it is envisaged according to the invention that the coolant is introduced into a coolant container and the coolant container is inserted into the at least one space in the piston. This results in the advantage that first of all a coolant container is made available and filled with the suitable coolant. This takes place independently of the production of the piston per se. After the coolant container filled with the coolant and closed has been produced and made available, it can be inserted into the space provided for it in the piston. This simplifies the production of the piston per se quite considerably since it is no longer necessary to work with the coolant per se. This is made available after being enclosed gas tightly in the coolant container, which can be handled without any problems. This handling is manual but can also be automated.

After the coolant container has been inserted into the space provided for it in the piston, there are several possibilities as regards the configuration of the piston or as regards the next method step. On the one hand, it is envisaged according to the invention that the space is closed with a closure means after the insertion of the coolant container. This closure element can be the known ball, but any other separate closure means can be inserted and brought into operative connection with the introduction opening of the space in order to close said space with the coolant container situated therein. If a closure means is inserted, it is conceivable that the coolant container is arranged in a positively locked manner in the space and thus can no longer move relative to the piston. As an alternative, it is conceivable that the coolant container still has a certain play in the space after the closure of the space and hence that movement is possible. The fixed arrangement has the advantage that heat can thereby be more effectively transferred to the coolant and dissipated into regions that are subject to significantly lower stresses in terms of temperature. The movement of the coolant container in the space has the same advantage since the upward and downward movement of the piston during operation in the cylinder of the combustion engine means that it can likewise absorb heat in highly stressed regions and release said heat in less highly stressed regions if it moves in the space.

As an alternative, it is envisaged, as a development of the invention, that, after insertion into the space, the coolant container is fixed in its position there. This can be accomplished by press-fitting, adhesive bonding or other suitable measures, for example, which ensure that the coolant container is permanently fixed in its position after insertion into the associated space in the piston. On the one hand, this has the advantage that, as already described above, good heat transfer and hence heat dissipation from regions which are highly stressed in terms of temperature into regions which are less highly stressed in terms of temperature are likewise ensured. Moreover, closure of the insertion opening of the space can be omitted, thereby simplifying the production of the piston even further.

If the space is closed with a closure means after the insertion of the coolant container or the insertion opening remains open, this insertion opening is preferably provided in the inner region of the piston, which is not subject to further machining If the insertion opening is situated in the outer region of the piston, e.g. in the region above, below or within the ring zone or the skirt zone, it is possible to work with a separate closure means which is reworked after insertion and closure. Both in the case of closure of the insertion opening in the inner region or in the outer region of the piston, consideration can be given to welding, brazing or bonding the insertion opening shut or the like, instead of a separate closure element. Here too, the closed insertion opening can be reworked after the closure process.

As a development of the invention, it is envisaged that the coolant container is of elongate and cylindrical design, being designed as a tube for example. This has the advantage that, by virtue of this elongate extent of the coolant container, one end is arranged in a region which is highly stressed in terms of temperature and the other end is arranged in a region which is less highly stressed in terms of temperature. Owing to the upward and downward movement of the piston in the cylinder of the combustion engine, suitable alignment of the coolant container ensures that the coolant in the coolant container absorbs the heat in the highly stressed regions and dissipates it in the direction of the less highly stressed regions. This heat transfer can take place continuously, especially if the coolant container is completely filled with the coolant. However, discontinuous heat transfer is also conceivable, especially if the coolant container is not completely filled with the coolant and said coolant can move backward and forward between the two ends of the coolant container.

Thus far, it has been assumed that the space for accommodating the coolant container is introduced into the piston during the production of the piston (e.g. by casting the piston with lost cores, which are flushed out and then form the space to accommodate the coolant container) or more space is introduced after the production of the piston, e.g. by drilling or the like. In an alternative embodiment of the invention, it is furthermore envisaged that the coolant container is cast into the piston. The coolant container which has been separately manufactured, filled with coolant and closed is made available in a suitable manner and inserted into a casting mold for the piston. This insertion resembles the insertion of a lost core for the production of cooling cavities, for example (e.g. annular cooling passages) into a casting mold for the piston. For example, the at least one coolant container can be secured on a mandrel of the casting mold. After the closure of the casting mold, it is filled with molten casting material, which surrounds the at least one coolant container (and any lost cores which may be present), with the result that, after the solidification of the molten casting material, the coolant container is arranged at the location envisaged for it within the piston and can perform its function.

The same above-described embodiments and the advantages resulting therefrom apply in the same way to the method according to the invention for the production of the piston.

One illustrative embodiment of a piston according to the invention, by means of which the production steps are also explained, is described below and shown in FIGS. 1 to 3.

DETAILED DESCRIPTION

Reference numeral 1 indicates, by way of example, a one-piece piston 1, which has an upper part 2. A piston skirt 3 adjoins the upper part 2, wherein, in this design of the piston, the two opposite sections of the piston skirt 3 are connected by connecting walls 4, in which a pin bore 5 is also arranged. The pin bores 5 to receive the ends of a piston pin can be present but do not have to be present. The ends of the piston pin can also be arranged in some other way on the lower side of the upper part 2. In a manner known per se, the upper part 2 has a ring zone 6, wherein a central region (FIG. 1) is denoted by 7 in the inner region of the piston 1.

A combustion chamber recess 8 can be present in the upper part 2 of the piston 1, as can a cooling passage 9 running around in the form of a ring. The combustion chamber recess 8 and/or the cooling passage 9 can, but need not be, present, depending on the intended use of the piston 1.

A closure for openings 11 of spaces 12 situated within the piston 1 is indicated by 10 in FIG. 1.

Figure 2:
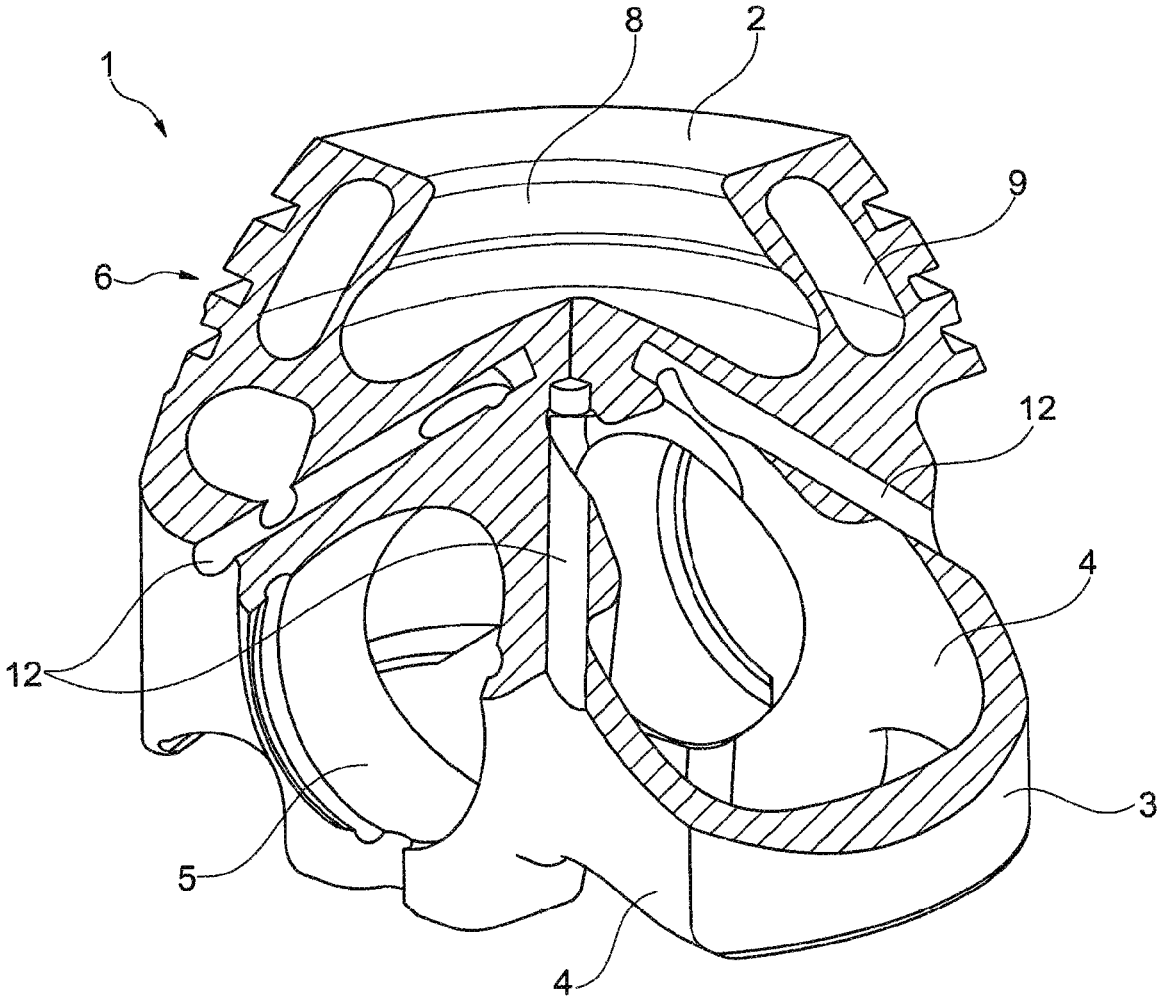

Considering FIG. 2, it becomes clear that, in principle, the at least one space 12, in this case a plurality of spaces 12, is arranged in the piston 1, i.e. within the solid material thereof. While, in FIG. 1, it is assumed that the openings 11 of the spaces 12 are accessible from the central region 7 (inner region of the piston 1), FIG. 2 illustrates that the openings 11 of the spaces 12 are accessible from the outer region of the piston 1 (e.g. from the connecting wall 4 or the piston skirt 3).

Irrespective of the direction from where the spaces 12 are accessible and where the openings 11 (insertion openings) thereof are located, the spaces 12 are thus introduced in the required numbers into the main body (solid material) of the piston after the production of the piston 1 (to be more precise of a piston blank) or during production itself. As already described, introduction can be accomplished by means of lost cores which are flushed out. Instead, the respective space 12 can be introduced by suitable methods, e.g. drilling, milling or the like, after the production of the piston blank. This can be seen, for example, from the piston shown in FIG. 2, where the spaces 12 are arranged obliquely in the piston 1 and are aligned in the direction of the central region 7.

Figure 3:
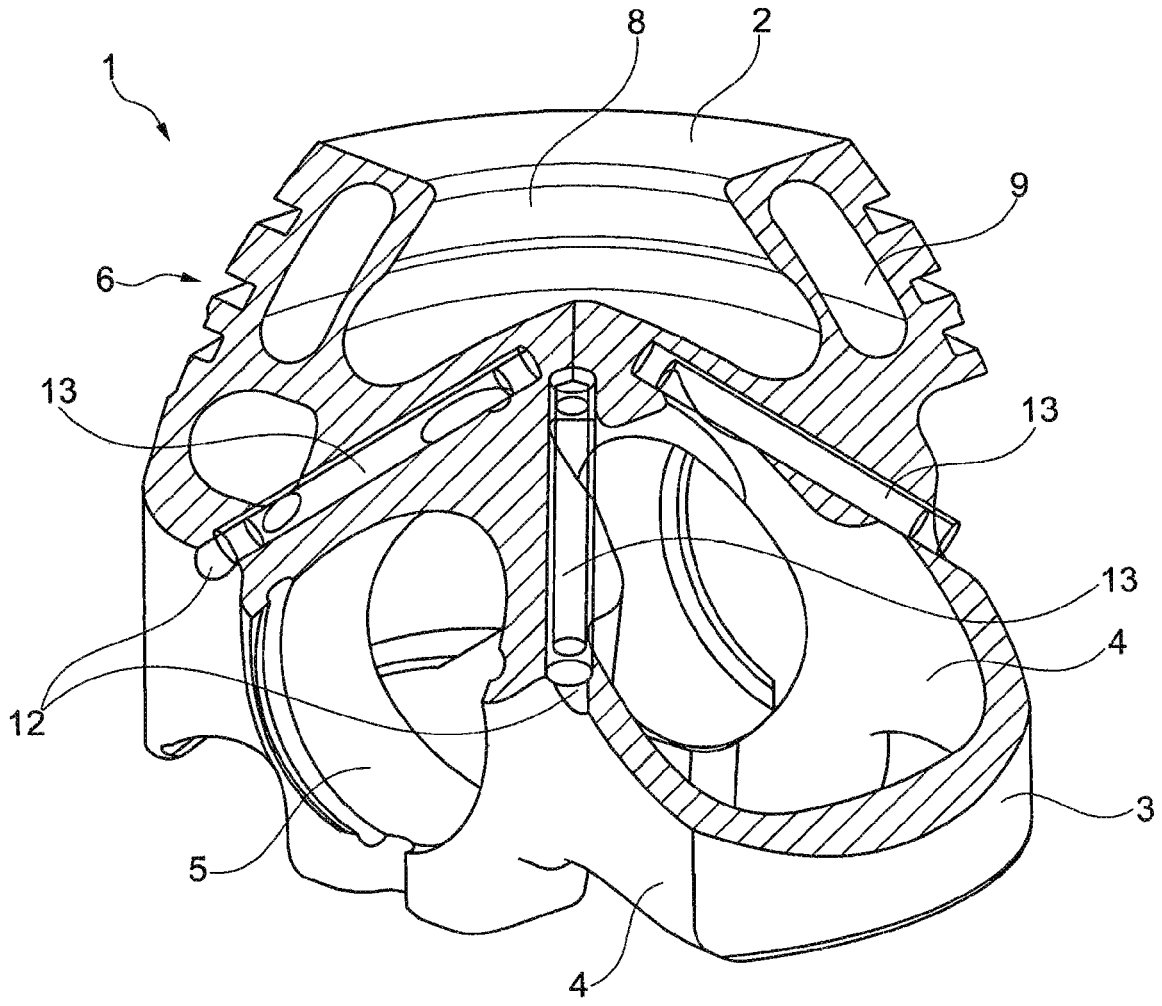

After a piston as shown in FIG. 2 has been prepared, coolant containers 13 that have previously been produced and filled with coolant are inserted into the spaces 12 provided for them, as illustrated in FIG. 3. After insertion, the associated openings 11 of the space 12 are closed, or the respective coolant container 13 is inserted into the space 12 in such a way that it is fixed permanently in its position there after the completion of the insertion process. It is absolutely imperative that this fixing in position should be performed in such a way that the coolant container 13 cannot move out of the space 12 during the upward and downward movement of the piston 1 in the cylinder of the combustion engine.

As can be seen in FIGS. 2 and 3, the spaces 12 and accordingly also the coolant containers 13 are of elongate and cylindrical configuration. This elongate and cylindrical configuration enables the coolant container 13 to be produced in a simple manner by using tubular material, which is closed at one end, for example, and then filled with the coolant, after which, in turn, the other end is closed gas tightly. Moreover, this elongate configuration has the advantage that the strength of the piston 1 is weakened only slightly, if at all, when the spaces 12 are introduced. It can be regarded as a further advantage that, by virtue of the elongate extent of the coolant container 12, very good heat transfer can take place from the regions which are highly stressed in terms of temperature (in the illustrative example the internally situated dome of the combustion chamber recess 8, for example) in the direction of regions which are less highly stressed in terms of temperature.

To fill the coolant container 12 and for heat transfer, any suitable coolant may be considered. Alkali metals, e.g. sodium, are of particular advantage since they have very good heat transfer in the temperature working range of the piston 1.

LIST OF REFERENCE SIGNS

1. piston
2. upper part
3. piston skirt
4. connecting wall
5. pin bore
6. ring zone
7. central region
8. combustion chamber recess
9. cooling passage
10. closure
11. openings
12. space
13. coolant container

What is claimed is:

1. A method for the production of a piston of a combustion engine, having an upper part with a ring zone and a piston skirt adjoining the upper part, the piston upper part and the skirt defining a central region, the method comprising:

forming at least two elongated spaces obliquely positioned in the piston and aligned in a direction of the central region;

installing the coolant into each of at least two coolant containers; and installing each of the at least two coolant containers into one of the at least two spaces in the piston.

2. The method of claim 1 wherein the central region defines a central region opening, the forming of each of the at least two elongated spaces further comprising forming an opening positioned in the central region opening in fluid flow communication with, and accessible to receive a respective container through, the central region opening; and installing a closure element in the central region opening operable to close the at least two spaces respective opening.

3. The method of claim 1 further comprising:

fixedly engaging each of the at least two coolant containers inside one of the at least two spaces in the piston.

4. The method of claim 1 wherein forming the at least two elongated spaces aligned in a direction of the central region further comprising:

forming the at least two spaces such that a longitudinal axis of each of the at least two spaces intersect in the piston central region.

5. A combustion engine piston comprising:

an upper part having a ring zone;

a piston skirt connected to the upper part, the piston upper part and skirt defining a central region;

at least two elongated spaces defined by the piston, each elongated space is obliquely positioned and aligned in a direction of the central region; and at least two coolant containers operable to first receive and house a coolant, each of the at least two coolant containers and received coolant are respectively positioned in one of the at least two spaces.

6. The piston of claim 5, wherein after insertion into one of the respective at least two spaces, the coolant container is fixed in its position in the respective space.

7. The piston of claim 5 wherein the coolant container further comprises an elongated and cylindrical body.

8. The piston of claim 7 wherein the central region defines a central region opening and each of the at least two spaces each defining a longitudinal axis and an opening, wherein the openings are positioned in, are in fluid flow communication with, and are accessible to receive a respective container through the piston central region opening.

9. The piston of claim 8 further comprising a closure element positioned in the central region opening operable to close each of the at least two space openings after the insertion of the respective coolant container in the respective space.

10. The piston of claim 9 wherein the coolant comprises an alkali metal.

11. The piston of claim 9 wherein the obliquely positioned at least two spaces respective longitudinal axes intersect in the piston central region.

12. The piston of claim 9 wherein the at least two spaces respective openings are positioned at a height above the piston pin bores.

13. The piston of claim 7 wherein the at least two spaces comprises a plurality of spaces each defining an opening, wherein the plurality of spaces openings are positioned at a piston outer wall.

14. The piston of claim 13 wherein the obliquely positioned at least two spaces each defining a longitudinal axis, and wherein the plurality of spaces aligned in the direction of the central region comprises the respective longitudinal axis intersecting in the piston central region.

15. A method for producing a combustion engine piston having an upper part including a ring zone, a piston skirt connected to the upper part, the upper part and the skirt defining a central region further defining a central region opening, the method comprising:

forming a plurality of cooling spaces in the piston, each of the plurality of cooling spaces obliquely positioned and aligned in a direction of the central region opening, each of the plurality of cooling spaces defining an opening;

installing a coolant in a plurality of coolant containers, the plurality of coolant containers separate and independent of the plurality of cooling spaces;

sealingly closing the plurality of coolant containers preventing the coolant from exiting the plurality of coolant containers;

installing the plurality of coolant containers including the coolant in respective of the plurality of cooling spaces; and preventing the coolant containers from exiting the cooling spaces.

16. The method of claim 15 wherein the forming of the plurality of cooling spaces and respective opening further comprises:

forming the opening for each of the plurality of cooling spaces in a central region opening of the piston, each of the cooling spaces respective openings accessible to receive a container through the central region opening.

17. The method of claim 16 wherein preventing the coolant containers from exiting the cooling spaces comprises:

installing a closure element positioned in the central region opening, the closure element operable to close the plurality of cooling spaces respective openings.

18. The method of claim 15 wherein the forming of the plurality of cooling spaces and respective opening further comprises:

forming the opening for each of the plurality of cooling spaces in an outer wall of the piston.

19. The method of claim 15 wherein installing the cooling containers in the respective of plurality of cooling spaces comprises casting the plurality of cooling containers in the piston.

20. The method of claim 15 wherein preventing the coolant containers from exiting the cooling spaces comprises:

fixedly securing the plurality of coolant containers in a respective of the plurality of coolant spaces.

* * * * *